US010819000B2

(12) United States Patent
Iino

(10) Patent No.: US 10,819,000 B2
(45) Date of Patent: Oct. 27, 2020

(54) COMPOSITE ANTENNA DEVICE

(71) Applicant: HARADA INDUSTRY CO., LTD., Tokyo (JP)

(72) Inventor: Shinji Iino, Tokyo (JP)

(73) Assignee: HARADA INDUSTRY CO., LTD., Tokyo (JP)

( * ) Notice: Subject to any disclaimer, the term of this patent is extended or adjusted under 35 U.S.C. 154(b) by 86 days.

(21) Appl. No.: 15/877,939

(22) Filed: Jan. 23, 2018

(65) Prior Publication Data

US 2018/0212301 A1 Jul. 26, 2018

(30) Foreign Application Priority Data

Jan. 24, 2017 (JP) ..... 2017-010060

(51) Int. Cl.

| | |
|---|---|
| ***H01Q 5/30*** | (2015.01) |
| ***H01Q 1/32*** | (2006.01) |
| ***H01Q 1/12*** | (2006.01) |
| ***H01Q 1/52*** | (2006.01) |
| ***H01Q 9/04*** | (2006.01) |
| ***H01Q 9/40*** | (2006.01) |

(Continued)

(52) U.S. Cl.

CPC ..... *H01Q 1/1214* (2013.01); *H01Q 1/12* (2013.01); *H01Q 1/32* (2013.01); *H01Q 1/3275* (2013.01); *H01Q 1/38* (2013.01); *H01Q 1/521* (2013.01); *H01Q 5/10* (2015.01); *H01Q 5/30* (2015.01); *H01Q 5/378* (2015.01); *H01Q 9/0428* (2013.01); *H01Q 9/40* (2013.01); *H01Q 19/22* (2013.01); *H01Q 21/30* (2013.01); *H01Q 21/065* (2013.01)

(58) Field of Classification Search

CPC ..... H01Q 1/1214; H01Q 1/521; H01Q 19/22; H01Q 9/40; H01Q 9/0428; H01Q 5/378; H01Q 1/3275; H01Q 5/30; H01Q 9/00; H01Q 1/32; H01Q 5/10; H01Q 1/12; H01Q 21/30; H01Q 1/38

USPC ..... 343/749, 713

See application file for complete search history.

(56) References Cited

U.S. PATENT DOCUMENTS 8,519,898 B2 * 8/2013 Sampo ..... H01Q 1/3275 343/749

8,816,917 B2 8/2014 Ueno et al.

(Continued)

FOREIGN PATENT DOCUMENTS

JP 2012-034226 A 2/2012

JP 2012-161075 A 8/2012

*Primary Examiner* — Hai V Tran

(74) *Attorney, Agent, or Firm* — Global IP Counselors, LLP

(57) ABSTRACT

A composite antenna device is provided that is capable of achieving gain enhancement of a patch antenna and further miniaturization of the entire device size. A composite antenna device capable of receiving signals of a plurality of frequency bands for a vehicle includes a base plate, a first antenna, and a second antenna. The first antenna is constituted by a patch antenna placed on the base plate and capable of receiving signals of a first frequency band. The second antenna is constituted by a capacitive antenna capable of receiving signals of a second frequency band lower than the first frequency band. The second antenna includes a top load portion disposed so as to cover the first antenna and has at least one conductive planar body functioning also as a wave director for the first antenna.

12 Claims, 5 Drawing Sheets

(51) Int. Cl.

| | |
|---|---|
| ***H01Q 19/22*** | (2006.01) |
| ***H01Q 5/378*** | (2015.01) |
| ***H01Q 1/38*** | (2006.01) |
| ***H01Q 21/30*** | (2006.01) |
| ***H01Q 5/10*** | (2015.01) |
| *H01Q 21/06* | (2006.01) |

(56) References Cited

U.S. PATENT DOCUMENTS

| | | | | |
|---|---|---|---|---|
| 9,252,494 | B2 * | 2/2016 | Hayashi | H01Q 9/42 |
| 2004/0075613 | A1 * | 4/2004 | Jarmuszewski | H01Q 1/243 343/702 |
| 2013/0285870 | A1 * | 10/2013 | Hotta | H01Q 1/243 343/843 |
| 2018/0331428 | A1 * | 11/2018 | Iino | H01Q 5/35 |

* cited by examiner

COMPOSITE ANTENNA DEVICE

BACKGROUND

Field of the Invention

The present invention relates to a composite antenna device, and more particularly to a composite antenna device capable of receiving signals of a plurality of frequency bands for a vehicle.

Description of the Related Art

As vehicle antenna devices, those capable of receiving AM and FM broadcasts are generally used. There are available several types of the vehicle antenna device, such as a rod antenna, a film antenna, and a glass antenna. Recently, there is also available so-called a shark-fin antenna which is an antenna device with small size and low-profile. As to an antenna length, a rod antenna or the like is designed so as to have a length as ¼ wavelengths of an FM broadcast frequency band. Further, in the vehicle antenna device, since an antenna height, i.e., a length protruding from a vehicle roof is restricted by regulations for exterior fittings, there exists a helical antenna in which an antenna element is wound helically to reduce the length thereof. However, in an AM broadcast frequency band, the antenna length is far shorter than the wavelength, with the result that the receiving sensitivity is significantly deteriorated. Therefore, the antenna device is developed, in which the height thereof can be reduced by attaching a metal top load portion to the open-end side of the antenna element for applying capacitance to configure the antenna element as a capacitive antenna.

For example, Patent Document 1 discloses a shark-fin type low-profile antenna device capable of receiving AM and FM broadcasts. This antenna device has a first helical portion and a second helical portion functioning as a top load portion so as to configure an AM/FM element. Further, this antenna device can mount, on a base plate, a GPS (Global Positioning System) patch antenna, an SDARS (Satellite Digital Audio Radio Service) patch antenna, or the like. However, in a composite antenna device like the low-profile antenna device disclosed in Patent Document 1, the AM/FM element inhibits performance of the patch antenna, so that it is necessary to separate the AM/FM element and the patch antenna from each other by a predetermined gap, thus inevitably enlarging the device size. Further, in order to ensure the performance of the patch antenna, the patch antenna needs to be disposed so as not to be covered by the AM/FM element, making layout design difficult.

As such an antenna element in which the patch antenna disposed below the AM/FM element is not affected by the AM/FM element, there is known an antenna device disclosed in Patent Document 2. The antenna device of Patent Document 2 is configured such that a captative plate functioning as the AM/FM element in the width direction has a dimension equal to or less than approximately ¼ wavelengths of a reception frequency of the patch antenna and is formed into a meander shape extending in the longitudinal direction thereof. A polarized component of the captative plate in the longitudinal direction in a reception wave of the patch antenna is orthogonal to a line disposed substantially parallel to the width direction, so that antenna characteristics of the patch antenna are less likely to be affected.

Patent Document 1: Japanese Patent Application Kokai Publication No. 2012-161075; and Patent Document 2: Japanese Patent Application Kokai Publication No. 2012-034226

Although an antenna device like that of Patent Document 2 is capable of making antenna characteristics of the patch antenna less likely to be affected, further improvement of antenna characteristics of the patch antenna or further miniaturization of the antenna device is now required.

SUMMARY

In view of such a situation, the present invention is intended to provide a composite antenna device capable of achieving gain enhancement of the patch antenna and further miniaturization of the entire device size.

To achieve the above-described object of the present invention, a composite antenna device of the present invention may include: a base plate fixed to a vehicle; a first antenna constituted by a patch antenna placed on the base plate and capable of receiving signals of a first frequency band; and a second antenna constituted by a capacitive antenna capable of receiving signals of a second frequency band lower than the first frequency band and including a top load portion disposed so as to cover the first antenna and having at least one conductive planar body functioning also as a wave director for the first antenna.

The top load portion of the second antenna may have at least one substantially square conductive planar body.

The second antenna may have at least one stub that electrically divides the top load portion into a plurality of substantially square conductive planar bodies.

The stub may have an arrangement position that can be adjusted based on the first antenna.

The stub may be formed by a folded pattern constituted by a plurality of slits arranged on the top load portion in a staggered manner so that currents flow in such directions that they are cancelled out with each other.

The stub may have the slits whose length and/or arrangement position can adjust antenna characteristics of the first and second antennas.

The conductive planar body may have a form designed according to a size of the patch antenna of the first antenna.

The top load portion may be a planar shape.

The top load portion may have a planar parallel portion extending parallel to the base plate and a planar inclined portion extending obliquely with respect to the base plate.

The top load portion may be constituted by a streamlined member having a top portion extending in the longitudinal direction thereof and side surface portions extending to both sides from the top portion.

The second antenna may further have a coil whose one end is connected to the top load portion such that the top load portion functions as an AM antenna and that the top load portion and the coil function as an FM antenna.

The composite antenna device may further include an amplifier substrate, wherein the other end of the coil on the side opposite to the one end thereof connected to the top load portion is connected to the amplifier substrate.

The first antenna may be constituted by a stacked patch antenna.

The advantage of the composite antenna device according to the present invention is that a gain of a patch antenna can be improved and the further miniaturization of the entire device size can be achieved.

DETAILED DESCRIPTION OF EMBODIMENTS

Figure 1A:
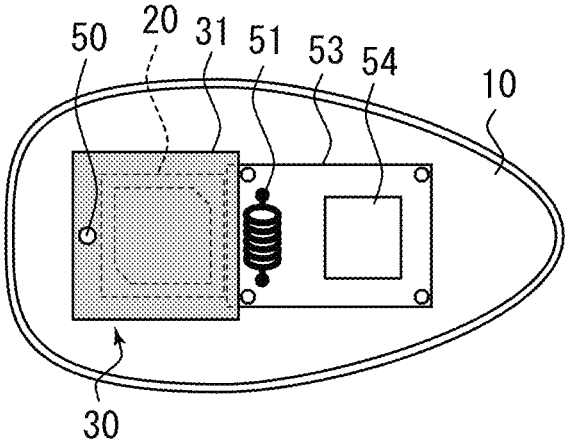
FIGS. 1A to 1C are partially cross-sectional schematic views, each explaining a composite antenna device according to the present invention.
Figure 1B:
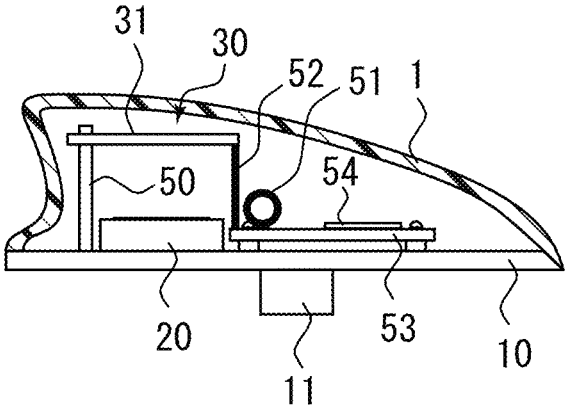
Figure 1C:
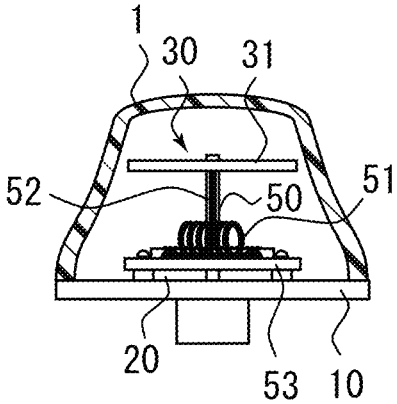

An embodiment for practicing the present invention will be described below with reference to the accompanying drawings. FIGS. 1A to 1C are partially cross-sectional schematic views, each explaining a composite antenna device according to the present invention. FIG. 1A is a plan view, FIG. 1B is a side view, and FIG. 1C is a front view. The composite antenna device according to the present invention can receive signals of a plurality of frequency bands for a vehicle and mainly includes a base plate 10, a first antenna 20, and a second antenna 30 as illustrated. The base plate 10, first antenna 20, and second antenna 30 are configured to be covered with an antenna cover 1. The antenna cover 1 has an inner space for housing an element or a circuit and defines an outer shape of the low-profile antenna device. The composite antenna device according to the present invention may be a composite antenna obtained by combining a capacitive antenna that can receive, e.g., signals of AM broadcast frequency band and a patch antenna for GPS, SDARS, or GLONASS.

The base plate 10 is a portion to be fixed to a vehicle body. Specifically, the base plate 10 may be so-called a resin base made of an insulator such as resin or so-called a metal base made of a conductor such as metal. Further alternatively, the base plate 10 may be a resin-metal composite base. The base plate 10 is provided with, e.g., a screw boss 11. The screw boss 11 is inserted into a hole formed in a vehicle roof, and the base plate 10 is fixed by using a nut from the inside of the vehicle to sandwich the roof. A cable for connecting between the inside of the vehicle and the antenna device is inserted through the screw boss 11. Further, the base plate 10 is covered with the antenna cover 1. The inner space of the composite antenna device is sealed by fitting between the base plate 10 and the antenna cover 1.

The first antenna 20 is placed on the base plate 10. The first antenna 20 is a patch antenna that can receive signals of a first frequency band. The first antenna 20 may be a dielectric ceramic patch antenna using a circularly polarized wave. Specifically, the first antenna 20 may be a patch antenna for GPS, SDARS, or GLONASS that uses, e.g., a UHF band as a resonance frequency.

The first antenna 20 may be a stacked patch antenna. The stacked patch antenna is obtained by stacking a plurality of patch antennas having different frequency bands. For example, the first antenna 20 may be constituted by stacking a plurality of dielectric patch antennas or by stacking a dielectric patch antenna and a gap patch antenna.

The second antenna 30 is a capacitive antenna that can receive signals of a second frequency band lower than the first frequency band. Specifically, the second antenna 30 may be an AM antenna using, e.g., an MF band as a resonance frequency. The second antenna 30 is the capacitive antenna and has a top load portion 31. The top load portion 31 is disposed so as to cover the first antenna 20 from above. The top load portion 31 has a substantially square conductive planar body functioning also as a wave director for the first antenna 20. The top load portion 31 of the second antenna 30 of the illustrated example is formed of a substantially square planar plate. The term "substantially square shape" means that the shape need not be perfectly square and may be trapezoid, parallelogram, etc. which is somewhat different from a square as long as it can function as a wave director for the first antenna 20. Also, the conductive planar body of the top load portion 31 need not have a substantially square shape as long as it can function as a wave director for the first antenna 20 but may have, e.g., a circular shape. Antenna characteristics of the first antenna 20 or second antenna 30 can be adjusted depending on the shape of the top load portion 31.

The size of the conductive planar body of the top load portion 31 may be determined according to the size of the patch antenna of the first antenna 20. Specifically, the size of the conductive planar body may be set such that the length of one side of the conductive planar body is e.g., about ½ wavelengths or about ¼ wavelengths of the first frequency band. For example, when the first antenna 20 is configured as a GPS patch antenna, the first frequency band is 1575.42 MHz, and a wavelength obtained at this time is about 20 cm. In this case, the substantially square conductive planar body of the top load portion 31 may be designed such that the length of one side thereof is, e.g., 5 cm as ¼ wavelengths. The ½ or ¼ wavelength-size of the one side can appropriately be changed for adjustment of the antenna characteristics of the first antenna 20 or second antenna 30. Further, there is a shortening effect according to a dielectric constant of the dielectric body of the patch antenna of the first antenna 20, so that it is possible to appropriately reduce the size of the top load portion 31.

The illustrated conductive planar body of the top load portion 31 extends parallel to the base plate 10 and is held by a retaining portion 50 in such a way as to be spaced apart from the first antenna 20 by a predetermined height. The height may be set to a value corresponding to the resonance frequency of the first antenna 20. The reason is that the conductive planar body functions as a wave director for the first antenna 20 as described later. Specifically, the height may be adjusted in the range of about 10 mm to about 50 mm from the first antenna 20 so that the conductive planar body of the top load portion 31 functions as a wave director. It is also possible to appropriately control directivity of the first antenna 20 or the second antenna 30 depending on the distance between the conductive planar body and the first antenna 20 or depending on the size of the conductive planar body.

The conductive planar body of the top load portion 31 operates as the capacitive antenna in, e.g., an MF band (AM broadcast frequency band) to thereby be able to receive signals of the second frequency band; however, the present invention is not limited to this. In the composite antenna device of the present invention, the second antenna 30 may be configured as an AM/FM antenna. That is, the second antenna 30 may have a coil 51 to be connected to the top load portion 31. One end of the coil 51 is connected to the top load portion 31 by, e.g., a connection line 52. As a result, the top load portion 31 operates as the capacitive antenna to function as an AM antenna and, at the same time, the top load portion 31 and the coil 51 operate as a capacitive load antenna to function as an FM antenna whose element length is reduced.

As described above, in the composite antenna device according to the present invention, the top load portion 31 of the second antenna 30 as a capacitive load antenna is made to function as a wave director for the patch antenna of the first antenna 20, whereby gain of the first antenna can be improved.

Further, the second antenna 30 can be disposed so as to cover the first antenna 20 from above, allowing the installation space to be made smaller, which in turn can reduce the size of the entire composite antenna device.

Further, the second antenna 30 configured in the foregoing way may be connected to an amplifier substrate 53. An amplifier circuit 54 is placed on the amplifier substrate 53. The other end of the coil 51, that is, the other end of the side opposite to the one end of the coil 51 connected to the top load portion 31, is connected to the amplifier substrate 53.

As illustrated, in the composite antenna device according to the present invention, the position of the second antenna 30 is lowered to the base plate 10 side to configure the second antenna 30 as the flat top load portion 31, thereby allowing the foot side of the antenna cover 1 to be utilized more effectively than in a shark-fin antenna, whereby the surface area of the element can be widened. That is, capacity can be further increased. This allows improvement of characteristics of the top load portion 31 as an AM antenna and further lowering of the position of the top portion of the composite antenna device.

The capacity of the top load portion 31 of the second antenna 30 is preferably large when the top load portion 31 is constituted as a capacitive antenna. However, when the size of the top load portion 31 is simply increased, the top load portion 31 may fail to function as a wave director for the first antenna 20. In this case, antenna characteristics of the first antenna 20 are deteriorated. In order to overcome the problem, the composite antenna device according to the present invention is configured as follows.

Figure 2A:
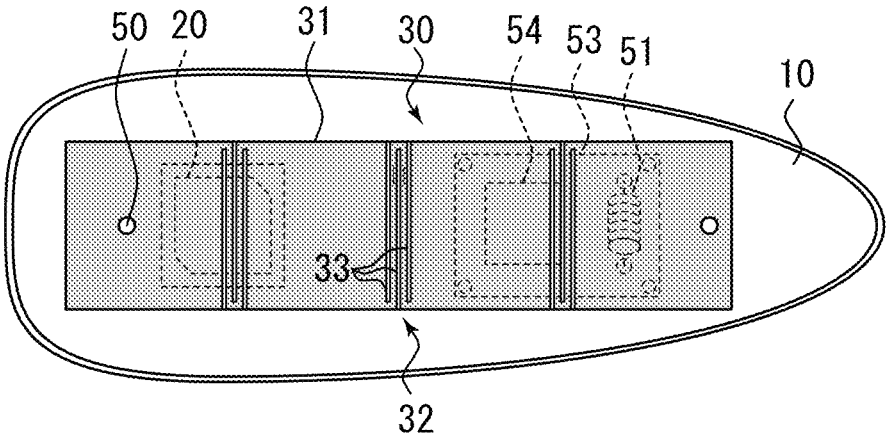
FIGS. 2A to 2C are partially cross-sectional schematic views, each explaining another example of the composite antenna device according to the present invention.
Figure 2B:
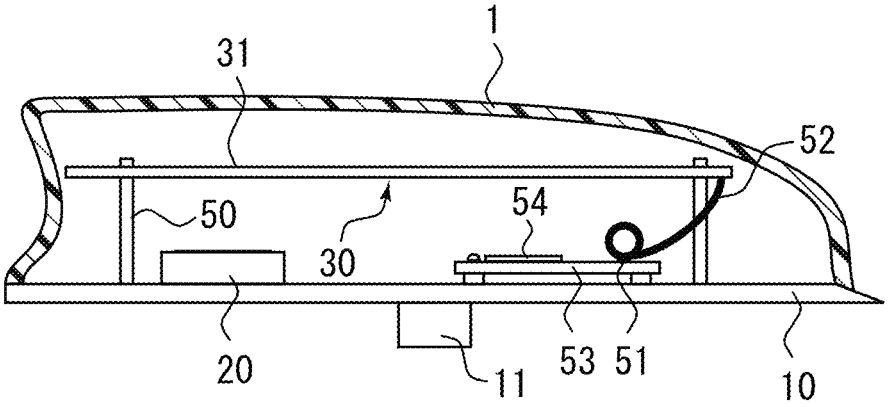
Figure 2C:
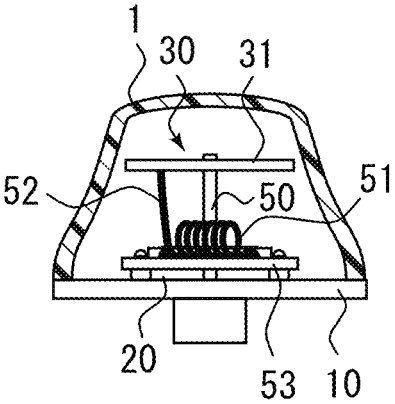

FIGS. 2A to 2C are partially cross-sectional schematic views, each explaining another example of the composite antenna device according to the present invention. FIG. 2A is a plan view, FIG. 2B is a side view, and FIG. 2C is a front view. In FIGS. 2A to 2C, the same reference numerals as those in FIGS. 1A to 1C denote the same parts as those in FIGS. 1A to 1C. In the example of FIGS. 1A to 1C, the top load portion 31 is constituted by one substantially square conductive planar body. However, the present invention is not limited to this, and as illustrated in FIGS. 2A to 2C, the top load portion 31 may be constituted by a plurality of substantially square conductive planar bodies. That is, the second antenna 30 has stubs 32 that electrically divide the top load portion 31 into the plurality of substantially square conductive planar bodies as viewed from the first antenna 20. In the illustrated example, the second antenna 30 is shown in which three stubs 32 are provided to divide the top load portion 31 into four substantially square conductive planar bodies. In the composite antenna device according to the present invention, the number of the stubs, i.e., the number of the conductive planar bodies is not limited to this. For example, a configuration may be possible in which one stub is provided to divide the top load portion into two substantially square conductive planar bodies, or more stubs are provided to obtain more conductive planar bodies.

This configuration allows the size of the top load portion 31 of the second antenna 30 to be increased, thus allowing the capacity thereof to be increased, thereby improving the antenna characteristics of the AM antenna. Further, the top load portion 31 functions as a plurality of wave directors for the first antenna 20, thereby further improving gain of the first antenna 20.

As illustrated, the stub 32 is formed by a folded pattern constituted by a plurality of slits 33 arranged on the top load portion 31 in a staggered manner so that currents flow in such directions that they are cancelled out with each other. More specifically, when the top load portion 31 is formed using, e.g., a copper foil of a printed board, the copper foil is etched to form the three slits 33 in a staggered manner to obtain one stub 32. By forming the plurality of slits 33 arranged in a staggered manner, currents flow in such directions that they are cancelled out with each other around the slits 33. As a result, in the first frequency band such as UHF band of the first antenna 20, the top load portion 31 behaves as a plurality of substantially square blocks. In the illustrated example, the three stubs 32 themselves are also arranged in a staggered manner; however, the present invention is not limited to this, and the three stubs may extend from the same side.

The stub to be used in the present invention is not limited to the illustrated example and may have any configuration as long as it can electrically divide the top load portion into a plurality of conductive planar bodies as viewed from the first antenna and electrically connect the plurality of conductive planar bodies so that the second antenna functions as the capacitive antenna.

The plurality of substantially square conductive planar bodies of the top load portion 31 thus divided by the stubs 32 function as wave directors for the first antenna 20. On the other hand, in the second frequency band such as MF band, and VHF band of the second antenna 30, the top load portion 31 behaves as an AM/FM antenna.

The composite antenna device according to the present invention is not limited to the above illustrated example. For example, a TEL antenna may be additionally provided in a vacant space.

The size of the conductive planar body of the top load portion 31 of the second antenna 30 may be determined according to the size of the patch antenna of the first antenna 20. Specifically, the size of the conductive planar body may be set such that the length of one side of the conductive planar body is about ¼ wavelengths of the first frequency band of the patch antenna. The higher the dielectric constant is, the larger the apparent size of the top load portion 31 than in reality is, because of the dielectric constant of the dielectric body of the patch antenna of the first antenna disposed below the second antenna 30. Thus, the higher the dielectric constant of the dielectric body of the first antenna 20 is, the smaller the top load portion 31 can be made.

The position of the stub 32 can be adjusted based on the first antenna 20. That is, the higher the dielectric constant of the dielectric body of the patch antenna of the first antenna 20 is, the narrower the interval between the adjacent stubs 32 can be. Further, the stubs 32 need not necessarily be arranged at equal intervals so that the top load portion 31 is divided into substantially square conductive planar bodies. The layout of the stubs 32 can be appropriately adjusted according to the antenna characteristics of the first antenna 20 or second antenna 30. For example, the stubs 32 can be arranged such that the conductive planar body nearer the first antenna 20 can be formed to be a smaller size.

Further, the antenna characteristics can be adjusted depending on the length and/or arrangement position of the slits 33 constituting each stub 32 disposed on the top load portion 31. That is, the length of the slit 33 may be changed for each stub 32. Further, the arrangement interval between adjacent slits 33 may be changed for each stub 32. The slit length or slit arrangement interval can be appropriately adjusted according to the antenna characteristics of the first antenna 20 or second antenna 30. When the slit length or slit arrangement is changed, the electric length of the second antenna 30 is changed, allowing the adjustment of the antenna characteristics of the second antenna 30.

Specifically, as in the composite antenna device illustrated in FIGS. 1A to 1C, when the first antenna 20 is configured as a GPS patch antenna, the first frequency band is 1575.42 MHz, and a wavelength obtained at this time is about 20 cm. In this case, in principle, the substantially square conductive planar body of the top load portion 31 may be designed such that the length of one side thereof is, e.g., 5 cm as ¼ wavelengths. Thus, in the case of the composite antenna device illustrated in FIGS. 2A to 2C, three stubs 32 are arranged at equal intervals of 5 cm. As a result, four 5 cm×5 cm conductive planar bodies are formed.

Here, a shortening effect is obtained according to a dielectric constant of the dielectric body of the patch antenna of the first antenna 20, so that it is possible to further reduce the size of the substantially conductive planar body of the top load portion 31. Specifically, when the first antenna 20 is a GPS patch antenna, the length of the top load portion 31 in the longitudinal direction can be set to 12 cm, and the length thereof in the short-side direction can be set to 3 cm. In this case, three stubs 32 are arranged at equal intervals of 3 cm. That is, four 3 cm×3 cm conductive planar bodies are formed. This means that four wave directors are provided for the first antenna 20. By the plurality of wave directors, the gain of the first antenna 20 can further be improved. Further, in this case, the size of the top load portion 31 is as large as 12 cm×3 cm and, thus, a sufficient capacity is obtained for the AM broadcast frequency band.

Figure 3A:
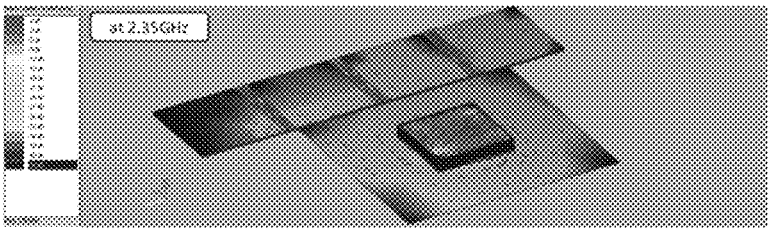
FIGS. 3A and 3B are current distribution views of each the top load portion of the composite antenna device according to the present invention illustrated in FIGS. 2A to 2C.
Figure 3B:
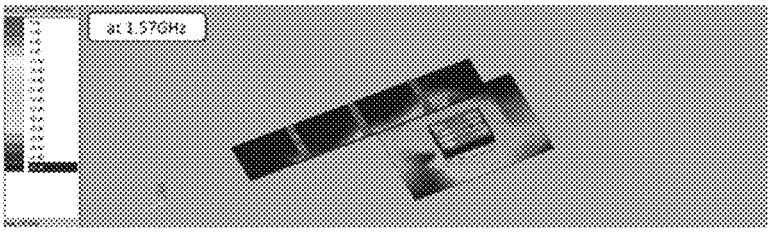

FIGS. 3A and 3B are current distribution views of each the top load portion of the composite antenna device according to the present invention illustrated in FIGS. 2A to 2C. FIG. 3A illustrates a current distribution in the frequency band of an SDARS patch antenna of the first antenna, and FIG. 3B illustrates a current distribution in the frequency band of a GPS patch antenna of the first antenna. In FIGS. 3A and 3B, the same reference numerals as those in FIGS. 2A to 2C denote the same parts as those in FIGS. 2A to 2C. As illustrated, in the frequency bands of both the SDARS patch antenna and GPS patch antenna, the top load portion 31 of the second antenna 30 is divided into four substantially square blocks by the plurality of stubs 32.

In the composite antenna device according to the present invention having the above configuration, the gain of the first antenna can be improved, and the capacity of the top load portion of the second antenna can be increased. Further, the top load portion can be disposed so as to cover the first antenna from above, allowing miniaturization of the entire device size. Further, the top load portion 31 of the second antenna 30 can be further reduced in size according to the dielectric constant of the dielectric body of the first antenna 20.

Figure 4A:
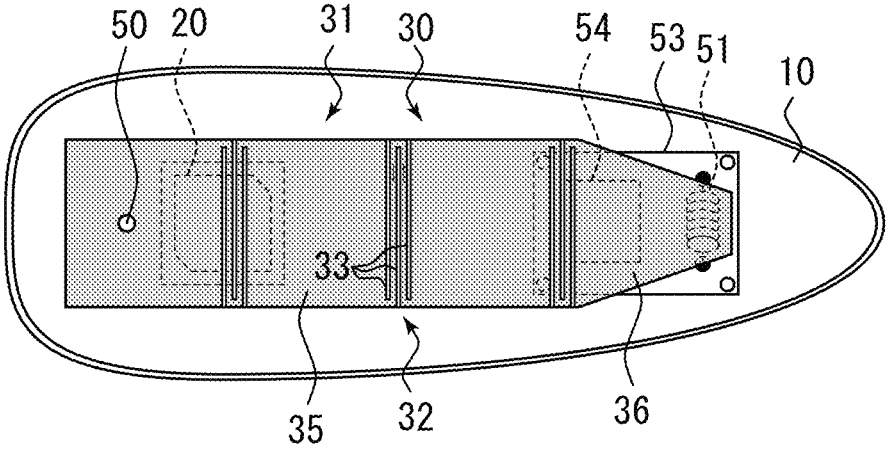
FIGS. 4A to 4C are partially cross-sectional schematic views, each explaining another example of the top load portion of the composite antenna device according to the present invention.
Figure 4B:
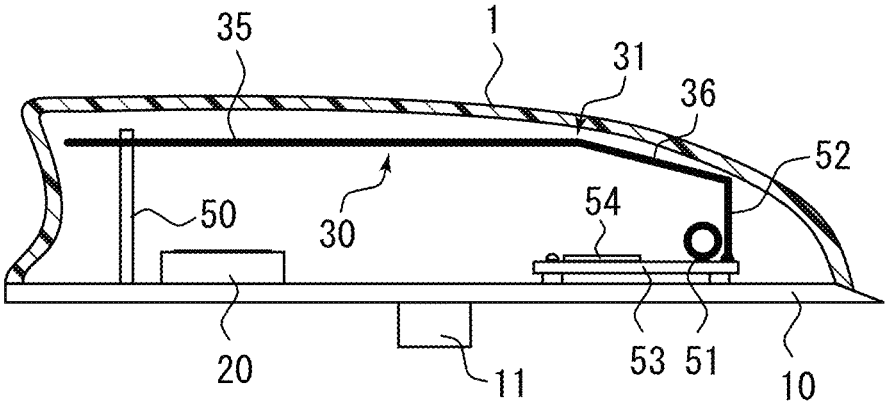
Figure 4C:
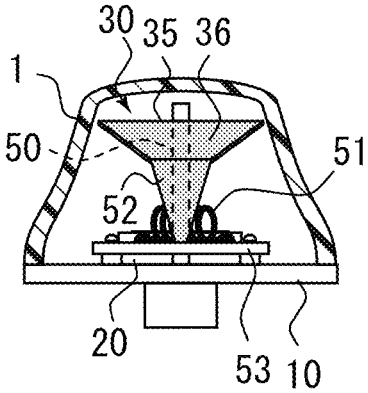

Next, another example of the top load portion of the composite antenna device according to the present invention will be described using FIGS. 4A to 4C. FIGS. 4A to 4C are partially cross-sectional schematic views, each explaining another example of the top load portion of the composite antenna device according to the present invention. FIG. 4A is a plan view, FIG. 4B is a side view, and FIG. 4C is a front view. In FIGS. 4A to 4C, the same reference numerals as those in FIGS. 2A to 2C denote the same parts as those in FIGS. 2A to 2C. In the previous example of FIGS. 2A to 2C, the top load portion 31 is constituted by only a portion that extends parallel to the base plate 10, i.e., one flat plate. However, the present invention is not limited to this, and as illustrated in FIGS. 4A to 4C, the top load portion 31 may be constituted by a planar parallel portion 35 extending parallel to the base plate 10 and a planar inclined portion 36 extending obliquely with respect to the base plate 10. With this configuration, a portion of the front-end side of the antenna cover 1 where the height of the antenna cover 1 is lowered can be utilized more effectively.

Further, in the illustrated example, the planar inclined portion 36 has a tapered shape toward the connection line 52. When the distance between the base plate 10 or a conductive portion of the vehicle and the planar inclined portion 36 is reduced, the antenna performance may be deteriorated due to the capacitive coupling. Thus, the planar inclined portion 36 is formed into a tapered shape so as to reduce the capacitive coupling, whereby deterioration of the antenna performance is minimized. However, the planar inclined portion 36 may have the same width as the width of the planar parallel portion 35 in the short-side direction under a certain receiving sensitivity condition.

Further, in the illustrated example, the connection line 52 has a tapered shape toward the coil 51. This allows achievement of a wider bandwidth in, particularly, a VHF band (FM broadcast frequency band). However, the connection line 52 may have a linear shape or a square shape under a certain receiving sensitivity condition.

Further, in the illustrated example, the planar parallel portion 35 and the planar inclined portion 36 constituting the top load portion 31, and the connection line 52 are integrally formed. For example, the top load portion 31 is formed by a conductive plate bent into a predetermined shape by sheet-metal processing. The planar parallel portion 35, the planar inclined portion 36, and the connection line 52 need not necessarily be integrally formed, and may be formed separately from each other.

Figure 5A:
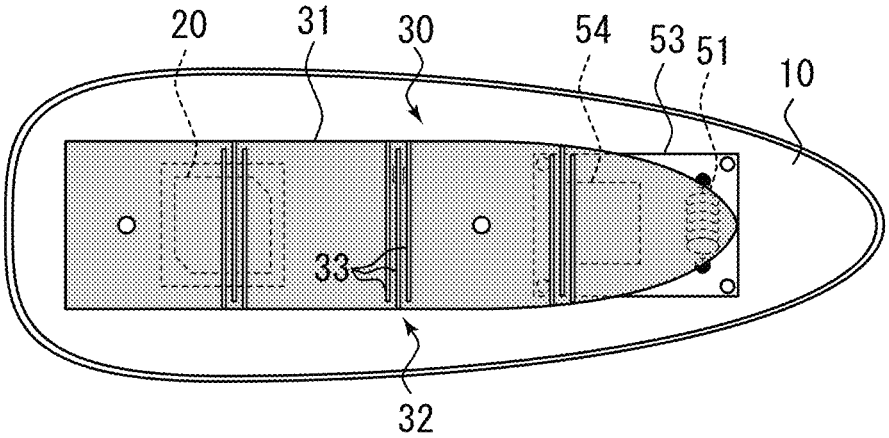
FIGS. 5A to 5C are partially cross-sectional schematic views, each explaining still another example of the top load portion of the composite antenna device according to the present invention.
Figure 5B:
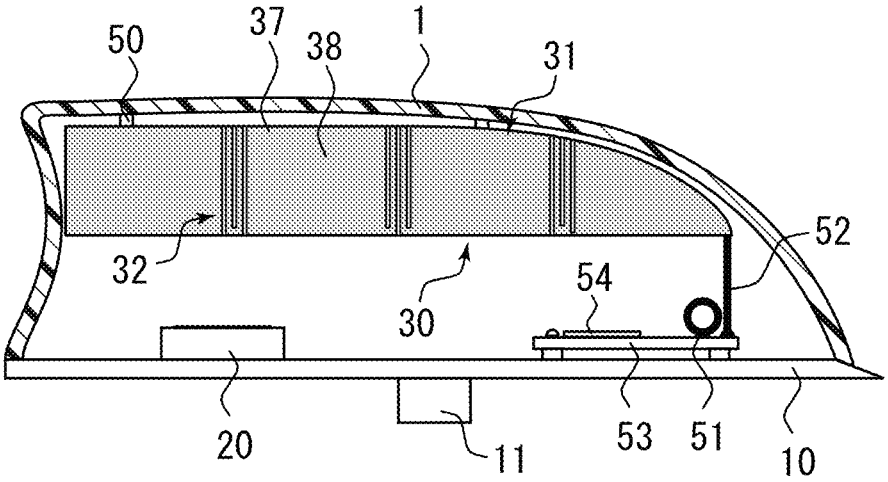
Figure 5C:
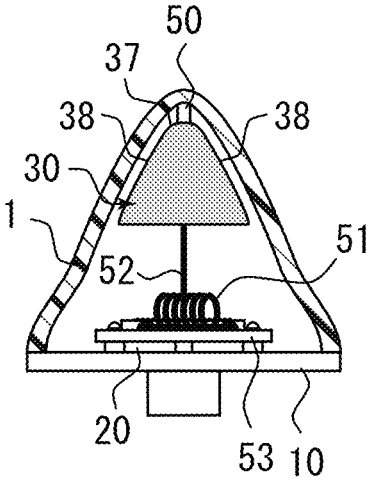

Still another example of the top load portion of the composite antenna device according to the present invention will be described by using FIGS. 5A to 5C. FIGS. 5A to 5C are partially cross-sectional schematic views, each explaining still another example of the top load portion of the composite antenna device according to the present invention. FIG. 5A is a plan view, FIG. 5B is a side view, and FIG. 5C is a front view. In FIGS. 5A to 5C, the same reference numerals as those in FIGS. 2A to 2C denote the same parts as those in FIGS. 2A to 2C. In the previous example of FIGS. 2A to 2C, the top load portion 31 is constituted by only a portion that extends parallel to the base plate 10. However, the present invention is not limited to this, and as illustrated in FIGS. 5A to 5C, the top load portion 31 may be constituted by a streamlined member having a top portion 37 extending in the longitudinal direction thereof and a side surface portion 38 extending to both sides from the top portion 37. With this configuration, the top load portion 31 of the second antenna 30 can be formed along the shape of the antenna cover 1 having, e.g., a shark-fin shape. The top portion 37 is not limited to the shape along the ridge-line of the illustrated shark-fin shape, and may have a configuration having a planar top portion and a side surface portion extending from both sides of the planar top portion.

As in the above illustrated examples, even with the structure illustrated in FIGS. 5A to 5C, the plurality of stubs 32 may be arranged on the top load portion 31 so as to electrically divide the top load portion 31 into a plurality of substantially square conductive planar bodies. The substantially square conductive planar body has a substantially square shape as viewed on the plan view.

In the example of FIGS. 5A to 5C, the retaining portion 50 of the top load portion 31 is provided on the antenna cover 1 side. However, the present invention is not limited to this, and the retaining portion 50 may be provided on the base plate 10 as in the examples of FIGS. 1A to 1C and FIGS. 2A to 2C.

The composite antenna device according to the present invention is not limited to those described above with reference to the drawings. Various changes may be made without departing from the scope of the present invention.

What is claimed is:

1. A composite antenna device capable of receiving signals of a plurality of frequency bands for a vehicle, the composite antenna device comprising:

a base plate fixed to the vehicle;

a first antenna constituted by a patch antenna placed on the base plate and capable of receiving signals of a first frequency band; and a second antenna constituted by a capacitive antenna capable of receiving signals of a second frequency band lower than the first frequency band and including a top load portion disposed so as to cover the first antenna and having at least one substantially square conductive planar body so as to function also as a wave director for enhancing a gain of the first antenna.

2. The composite antenna device according to claim 1, wherein the second antenna has at least one stub that electrically divides the top load portion into a plurality of substantially square conductive planar bodies.

3. The composite antenna device according to claim 2, wherein the stub has an arrangement position that can be adjusted based on the first antenna.

4. The composite antenna device according to claim 2, wherein the stub is formed by a folded pattern constituted by a plurality of slits arranged on the top load portion in a staggered manner so that currents flow in cancelling directions in which the currents are cancelled out with each other.

5. The composite antenna device according to claim 4, wherein the stub has the plurality of slits whose length and/or arrangement position can adjust antenna characteristics of the first and second antennas.

6. The composite antenna device according to claim 1, wherein the conductive planar body has a form designed according to a size of the patch antenna of the first antenna.

7. The composite antenna device according to claim 1, wherein the top load portion has a planar shape.

8. The composite antenna device according to claim 7, wherein the top load portion has a planar parallel portion extending parallel to the base plate and a planar inclined portion extending obliquely with respect to the base plate.

9. The composite antenna device according to claim 1, wherein the top load portion is constituted by a streamlined member having a top portion extending in the longitudinal direction thereof and side surface portions extending to both sides from the top portion.

10. The composite antenna device according to claim 1, wherein the second antenna further has a coil whose one end is connected to the top load portion such that the top load portion functions as an AM antenna and that the top load portion and the coil function as an FM antenna.

11. The composite antenna device according to claim 10, further comprising an amplifier substrate, wherein the other end of the coil on the side opposite to the one end thereof connected to the top load portion is connected to the amplifier substrate.

12. The composite antenna device according to claim 1, wherein the first antenna is constituted by a stacked patch antenna.

* * * * *